US005638911A

United States Patent [19]

Beechwood et al.

[11] Patent Number: 5,638,911

[45] Date of Patent: Jun. 17, 1997

[54] DRILLING APPARATUS AND SUPPORT MOUNT ASSEMBLY FOR USE THEREIN

[75] Inventors: Gregory F. Beechwood, Joplin; C. David Comstock, Carterville, both of Mo.

[73] Assignee: Mid-Western Machinery Co., Inc., Joplin, Mo.

[21] Appl. No.: 548,198

[22] Filed: Oct. 25, 1995

[51] Int. Cl.[6] ..... E21B 3/02; E21B 7/02

[52] U.S. Cl. ..... 175/162; 175/122; 175/220; 173/32; 173/185

[58] Field of Search ..... 173/39, 28, 166, 173/185, 186, 213, 220; 175/19, 220, 122, 162, 189, 202, 203

[56] References Cited

U.S. PATENT DOCUMENTS

| | | | |
|---|---|---|---|
| 2,667,752 | 2/1954 | Moseley | 61/73 |
| 3,302,735 | 2/1967 | Klem et al. | 175/122 |
| 3,447,652 | 6/1969 | Tipton | 192/85 |
| 3,493,200 | 2/1970 | Huffman | 248/16 |
| 3,721,305 | 3/1973 | Mayer et al. | 173/20 |
| 3,722,861 | 3/1973 | Anderson | 254/64 |
| 3,783,953 | 1/1974 | Kopaska | 173/187 |
| 3,896,887 | 7/1975 | Council | 173/43 |
| 4,088,289 | 5/1978 | Wood et al. | 248/2 |
| 4,124,081 | 11/1978 | Deike | 173/28 |
| 4,161,988 | 7/1979 | Hart | 173/32 |
| 4,333,541 | 6/1982 | Doty | 175/162 |
| 4,405,020 | 9/1983 | Rassieur | 173/89 |
| 4,685,339 | 8/1987 | Philipenko | 73/864.45 |
| 4,889,192 | 12/1989 | Ricard | 173/22 |
| 5,033,554 | 7/1991 | Younes | 175/19 |
| 5,076,372 | 12/1991 | Hellbusch | 175/20 |
| 5,273,124 | 12/1993 | Lloyd et al. | 175/162 |
| 5,282,511 | 2/1994 | Burenga et al. | 173/184 |
| 5,289,887 | 3/1994 | Püttmann | 175/61 |
| 5,363,925 | 11/1994 | Gallagher | 173/186 |
| 5,524,716 | 6/1996 | Wachholz | 175/52 |

OTHER PUBLICATIONS

"Mid-Western Machinery—Drilling into the Construction World", *Construction Equipment Guide* (Jun. 17, 1995).

*Primary Examiner*—Frank Tsay
*Attorney, Agent, or Firm*—William R. Sharp

[57] ABSTRACT

A support mount assembly for use in a drilling apparatus comprises a support member, a connector for removably connecting the support member to a vehicle so that the support member is in a vertical orientation, a support flange integrally connected to the support member near the lower end thereof, a sleeve slidably received upon the support member so as to be longitudinally movable along the support member, a feed mount member preferably comprising a collar integrally connected to the sleeve, and a drill mount member preferably comprising a flange integrally connected to and longitudinally extending along the sleeve. A drilling apparatus using the support mount assembly further comprises a feed leg and a drill. The feed leg has a first feed leg member, such as a cylinder, secured to the feed mount member and a second feed leg member, such as a piston, secured to the support flange. The drill is secured to the drill mount member.

18 Claims, 6 Drawing Sheets

DRILLING APPARATUS AND SUPPORT MOUNT ASSEMBLY FOR USE THEREIN

BACKGROUND OF THE INVENTION

This invention relates to drilling equipment technology.

Vertical drilling into the ground or substrates such as concrete, asphalt, or rock is often required in utility (i.e. water, gas, etc.) and construction projects. A hand-held drill is typically used for such drilling. Although the hand-held drill is highly portable and generally adequate for light duty drilling of holes of only a few feet in depth, hand-held drilling can result in back and carpal tunnel injuries to the operator. High noise levels and the close proximity of the operator to the drill can also result in hearing loss if adequate ear protection is not used. In road construction projects, the operator must frequently operate the drill in high traffic areas, thus further increasing the risk of injury.

SUMMARY OF THE INVENTION

It is, therefore, an object of the invention to provide a drilling apparatus which is highly portable and suitable for construction and utility projects, and which is less dangerous and more convenient than hand-held drilling.

The above object is achieved by a drilling apparatus comprising: an elongated and substantially cylindrical support member having a longitudinal axis and opposing ends; a connector means for removably connecting the support member to the vehicle so as to hold the support member in at least one substantially vertically oriented fixed position with one end as the lower end and the other end as the upper end; a support flange integrally connected to and substantially radially and outwardly extending from the support member near the lower end thereof; a carriage having (i) a sleeve slidably received upon the support member so as to be longitudinally movable along a portion of the support member between the support flange and the upper end of the support member, (ii) a feed mount member having at least a portion integrally connected to the sleeve and wherein the feed mount member outwardly extends from the sleeve, and (iii) a drill mount member integrally connected to and outwardly extending from the sleeve; an elongated feed leg means having a longitudinal axis substantially parallel to the support member axis and having a first feed leg member fixedly secured to the feed mount member and a second feed leg member fixedly secured to the support flange, the first feed leg member being movably connected to the second feed leg member so as to be longitudinally movable with respect to the second feed leg member to thereby move the carriage in an upward or downward direction along said portion of the support member; and a drill means fixedly secured to the drill mount member in an orientation to receive a drill stem which extends from the drill means in a substantially downward direction.

According to another aspect of the invention, there is provided a support mount assembly comprising: a support member and connector means as described above; a first flange integrally connected to and substantially radially and outwardly extending from the support member near the lower end thereof; a substantially cylindrical sleeve substantially coaxial with the support member and slidably received upon the support member so as to be longitudinally movable along a portion of the support member between the first flange and the upper end; a substantially cylindrical collar having at least a portion integrally connected to the sleeve, wherein the collar outwardly extends from the sleeve and has a longitudinal axis substantially parallel to the support member axis, and wherein the collar is longitudinally aligned with at least a portion of the first flange; and a second flange integrally connected to and outwardly extending from the sleeve so as to longitudinally extend along the sleeve. In a drilling apparatus according to specific aspects of the invention employing a feed leg with a cylinder and a piston reciprocatingly received by the cylinder: the cylinder can be securedly but removably received through the collar (i.e. feed mount member) and a piston rod end can be fixedly but removably secured to the first flange (i.e. support flange); and a drill can be fixedly but removably secured to the second flange (i.e. drill mount member).

A drilling apparatus according to the invention can most conveniently be connected to a vehicle, such as a truck, by means of a conventional hitch as fixedly secured to the vehicle. The feed leg and drill can be operated remotely, such as from the truck cab, by pneumatic means. The drill can therefore be lowered by the feed leg to drill a hole, and then retracted by the feed leg once drilling is complete. The drilling apparatus can remain connected to the vehicle if moving a short distance to a new drilling location. Or, if the drilling apparatus must be disconnected, it can be easily loaded into the vehicle (i.e. bed of a pickup truck), moved to the new location, and then reconnected to the vehicle.

Therefore, the drilling apparatus of the invention is highly portable, making it particularly suitable for utility and construction drilling projects. The drilling apparatus can further be remotely operated to thereby optimize convenience and minimize risk of injury to the operator. Moreover, when used with a suitable rock drill and a foot member and pad for additional stability, the drilling apparatus is suitable for use in heavy duty applications, such as in quarries or mines, where deep holes in solid rock frequently need to be drilled. This application of the drilling apparatus makes it a very inexpensive alternative to mobile drilling rigs that have a drill and mast permanently mounted to a tracked vehicle.

DETAILED DESCRIPTION OF THE INVENTION

A preferred embodiment of the invention will now be described with reference to the FIGURES.

The term "vehicle", as used herein and in the appended claims, means any mobile piece of equipment, and includes, but is not limited to, any type of truck (i.e. pickup truck for aboveground use or "mucker" for underground use), a backhoe, a forklift, etc.

It is further understood that the term "integrally connected" as used in the description hereafter most preferably refers to a welded connection, but that such term is not limited to this particular type of connection. Members integrally connected to one another could be formed as a single integral piece.

Figure 1:
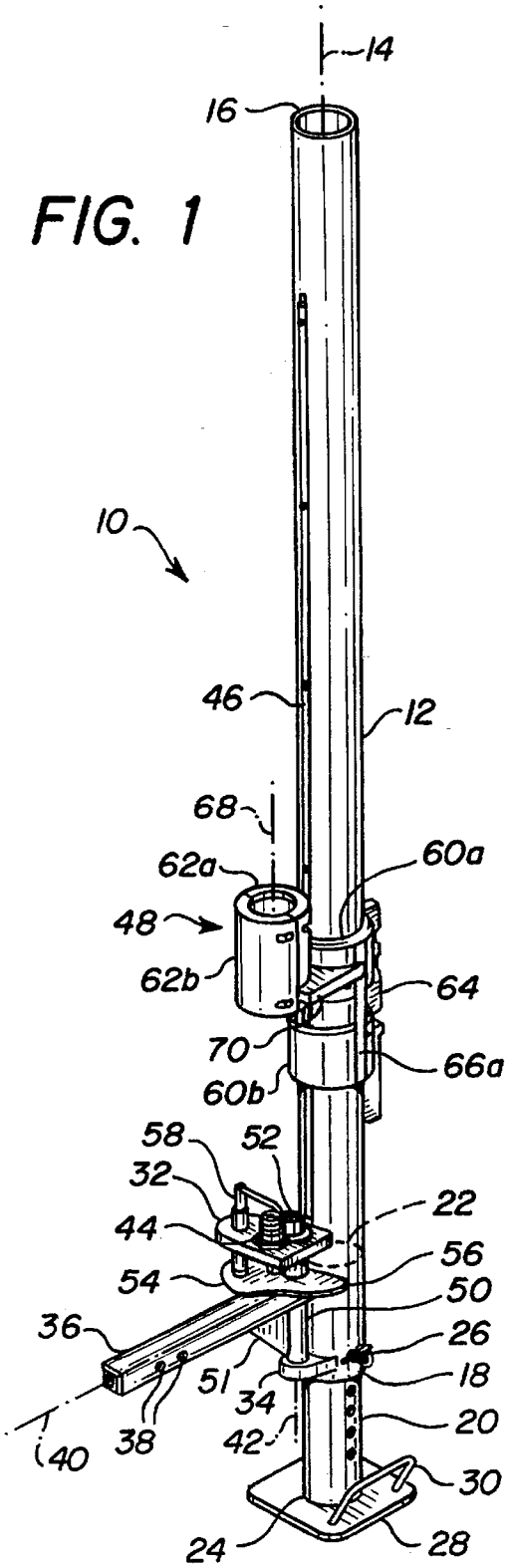
FIG. 1 is a perspective view of a support mount assembly in accordance with the invention.
Figure 2:
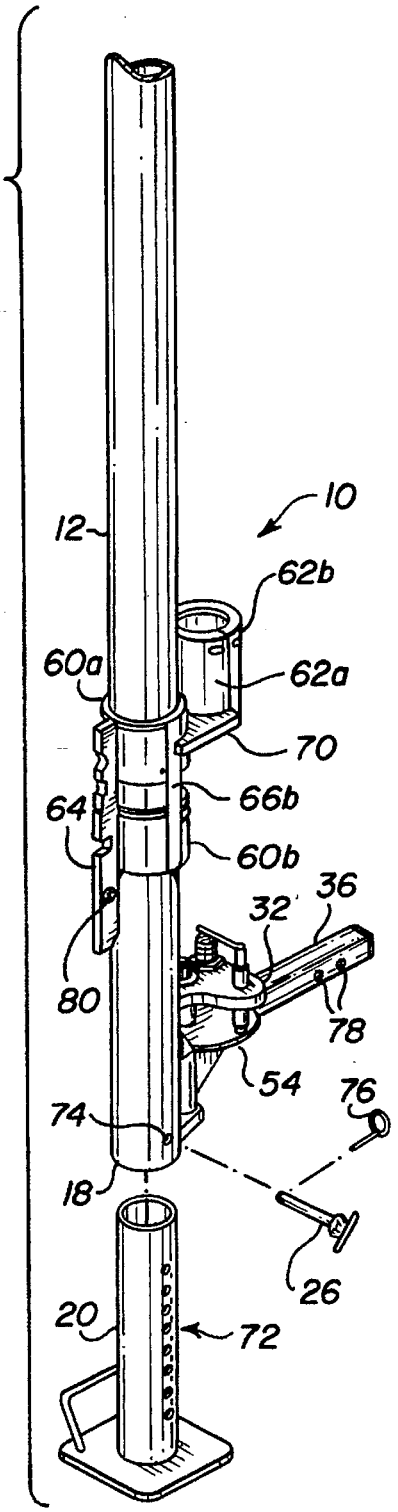
FIG. 2 is another and partially disassembled view of the support mount assembly of FIG. 1.
Figure 6:
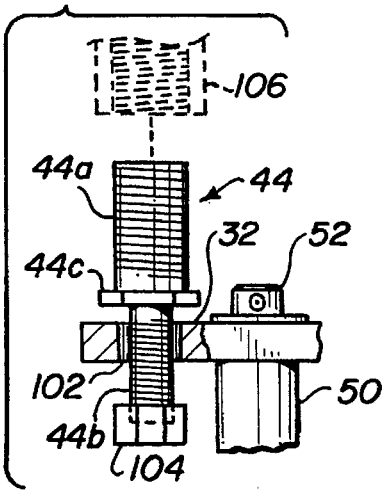
FIG. 6 is a disassembled view of a component shown in FIGS. 1 and 2.

Referring now to FIG. 1, the illustrated support mount assembly 10 comprises: an elongated and substantially cylindrical support member 12, preferably a tubular member and shown in its normal vertical orientation for use, having a longitudinal axis 14 and upper and lower ends 16 and 18, respectively; a tubular foot member 20 having an upper end 22 (shown by a broken line) and a lower end 24, and being substantially coaxially and telescopically received within support member 12 through its lower end 18 such that upper end 22 is within support member 12; a foot lock pin 26, discussed in further detail with reference to FIG. 2, for locking foot member 20 in a fixed position with respect to support member 12; a pad 28 integrally connected to lower end 24 and having a substantially planar surface which is substantially perpendicular to axis 14; a handle 30 integrally connected to pad 28; an upper support flange 32 integrally connected to and substantially radially and outwardly extending from support member 12 near its lower end 18; a lower support flange 34 integrally connected to and substantially radially and outwardly extending from support member 12 at a position between upper support flange 32 and lower end 18 or at lower end 18; a connector 36 comprising a tubular member having holes 38 through its wall and a longitudinal axis 40 substantially perpendicular to axis 14, connector 36 being pivotally connected to and between upper support flange 32 and lower support flange 34 to permit support member 12 to pivot around a pivot axis 42 substantially parallel to axis 14; a feed leg fastener bolt 44 fixedly but removably secured to upper support flange 32 and shown in detail in FIG. 6; and a key bar 46 fixedly secured to support member 12 by suitable means (i.e. screws) so as to longitudinally extend along a portion thereof between upper support flange 32 and upper end 16; and a carriage 48.

With regard to the pivotal connection of connector 36 to support member 12, a pivot pin housing 50 is integrally connected to connector 36 so as to longitudinally extend between upper support flange 32 and lower support flange 34. A reinforcement plate 51 is integrally connected between the lower portion of pivot pin housing 50 and connector 36. A pivot pin 52, of which only the upper end is visible in FIG. 1, is received through pivot pin housing 50. A pivot lock plate 54 and pivot stop plate 56 are integrally connected to connector 36 on opposite sides thereof, and are substantially parallel to upper support flange 32 and lower support flange 34. Pivot lock assembly 58 is provided for locking support member 12 in a desired position about pivot axis 40, as is shown and described in detail with reference to FIG. 3.

Carriage 48 includes a cylindrical sleeve 60 comprised of sleeve members **60*a* and 60*b*, a substantially cylindrical collar 62 outwardly extending from sleeve 60 and having a first collar half 62*a* and a second collar half 62*b*, and a flange 64 outwardly extending from sleeve 60. Sleeve 60 is substantially coaxially positioned with respect to support member 12, and is slidably received upon support member 12 so as to be longitudinally movable along key bar 46. Sleeve members 60*a* and 60*b* are longitudinally spaced but integrally connected to one another by means of a pair of connector bars 66*a* and 66*b*, of which only 66*a* is visible in FIG. 1. Collar 62 has a longitudinal axis 68 which is substantially parallel to axis 14, and collar 62 is longitudinally aligned with feed leg fastener bolt 44 and the portion of upper support flange 32 receiving such bolt. First collar half 62*a* is integrally connected to sleeve member 60*a* by means of a yoke 70, and second collar half 62*b* is fixedly secured to first collar half 62*a* but is separable therefrom, as will be more apparent from FIGS. 7 and 8. Flange 64 is integrally connected to and longitudinally extends along sleeve members 60*a* and 60*b***.

Referring now to FIG. 2, this view of support mount assembly 10 shows support member 12 and foot member 20 disassembled. Foot member 20 can be seen to have a plurality of longitudinally spaced holes 72 in its wall. Corresponding and radially aligned holes, some of which are visible in FIG. 1, extend through the wall of foot member 20 on the opposite side. Support member 12 has a hole 74 through its wall adjacent to lower end 18, and similarly has a corresponding and radially aligned hole, not visible in FIG. 2, on the opposite side. Foot lock pin 26 is adapted to be received through hole 74 and the corresponding opposing hole, as well as through one any one of holes 72 and its corresponding opposing hole. Therefore, the relative positions of support member 12 and foot member 20 can be longitudinally adjusted and locked in any one of a plurality of longitudinally spaced positions. A pin keeper 76 is adapted to be received through a radially extending hole at one end of foot lock pin 26 to ensure such pin remains in position during use of the support mount assembly.

The view of FIG. 2 additionally shows connecting bar **66*b* and holes 78 through the wall of connector 36, which are radially aligned with respective holes 38 in FIG. 1. FIG. 2 also more clearly shows the structure of flange 64. Flange 64 has a number of notches to accommodate protruding portions of a particular model of drill, and also has a hole 80 therethrough for use in mounting the drill to flange 64**.

Figure 3:
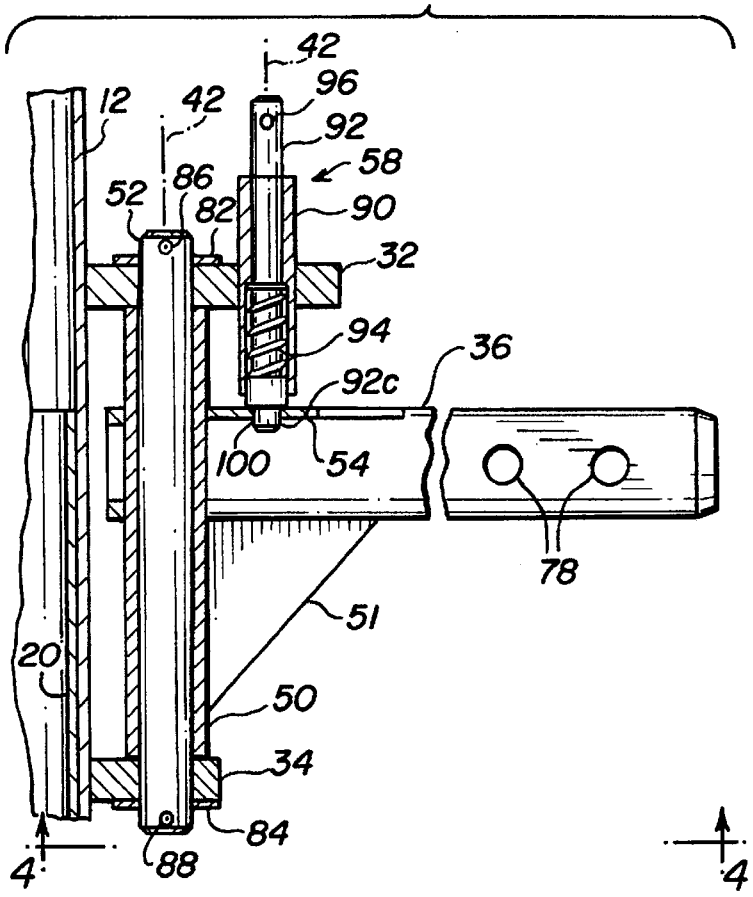
FIG. 3 is a cross-sectional view of a portion of the support mount assembly shown in FIGS. 1 and 2.

Referring now to FIG. 3, this cross-sectional view shows details of the pivotal connection between connector 36 and support member 12. Feed leg fastener bolt 44 is not shown in this view, or is assumed to have been removed, for clarity of illustration. Pivot pin housing 50 is integrally connected to connector 36 so as to extend between, but is not connected to, upper support flange 32 and lower support flange 34. Pivot pin 52 extends through pivot pin housing 50 and the support flanges so that the upper end of pivot pin 52 is above and closely adjacent to upper support flange 32, and so that the lower end of pivot pin 52 is below and closely adjacent to lower support flange 34. Washers 82 and 84 are received upon each end of pivot pin 52, and roll pins 86 and 88 are received through respective radially extending holes through pivot pin 52 at each end thereof to keep pivot pin 52 in its desired position as shown. The roll pins have hollow ends for receiving drift pins which enlarge such ends. Other types of pins, such as cotter pins, would be equally suitable. Upper and lower support flanges 32 and 34 are freely rotatable with respect to pivot pin housing 50 and pivot pin 52 to thereby allow support member 12 to pivot around pivot axis 42.

Figure 4:
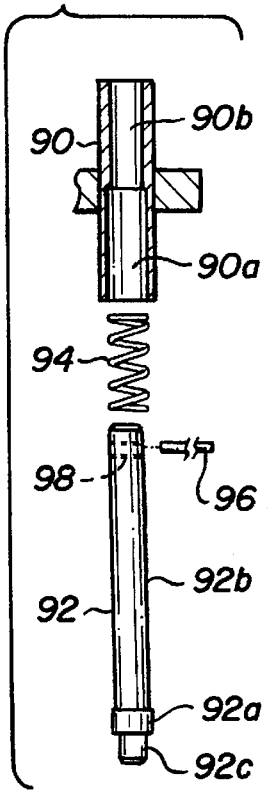
FIG. 4 is a disassembled view of a component shown in FIG. 3.
Figure 5:
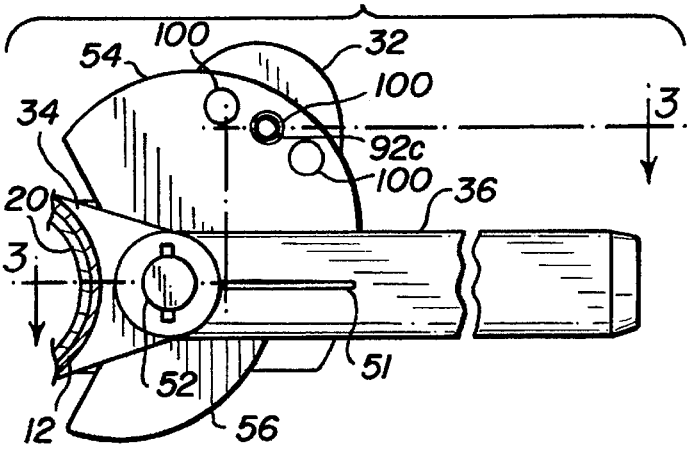
FIG. 5 is a view along line 4—4 in FIG. 3.

Referring to FIG. 3 in conjunction with FIGS. 4 and 5, pivot lock assembly 58 comprises a longitudinally extending pivot lock pin housing 90 integrally connected to upper support flange 32, pivot lock pin 92 (in FIG. 4 rotated 90 degrees from the position in FIG. 3) slidably received within pivot lock pin housing 90, a spring 94 received within a lower portion 90*a* of the pivot lock pin housing having an enlarged diameter as compared to upper portion 90*b*, and a pivot lock pin handle 96 snugly and securedly received through a radially extending hole 98 adjacent to the upper end of pivot lock pin 92. Pivot lock pin 92 has a portion 92*a* which has an enlarged diameter as compared to elongated portion 92*b* and tab portion 92*c*. Spring 94 thereby biases pivot lock pin 92 in a downward direction. Tab portion 92*c* of pivot lock pin 92 is received through any one of a plurality of holes 100 through pivot lock plate 54 to thereby lock support member 12 in any one of a corresponding plurality of pivot positions. To change to a different pivot position, the user simply uses handle 96 to pull up on pivot lock pin 92 and pull tab portion 92*c* from one of holes 100, followed by pivoting of support member 12 to a different position at which handle 96 is released to allow tab portion 92*c* to extend through another desired hole 100.

Referring now to FIG. 6, feed leg fastener bolt 44 is shown as being partially removed from upper support flange 32. Fastener bolt 44 has a first portion 44*a*, a second portion 44*b* having a smaller diameter than portion 44*a*, and a flange 44*c* between portions 44*a* and 44*b*. Portion 44*b* is sized to be received through a hole 102 in upper support flange 32, a portion of which is broken away to reveal hole 102. A nut 104 is adapted to be received upon portion 44*b* to fixedly but removably secure fastener bolt 44 to upper support flange 32. With fastener bolt 44 secured in such manner, flange 44*c* abuts the upper surface of upper support flange 32, as is shown in FIGS. 1 and 2. Portion 44*a* is adapted to be received within an internally threaded end of a piston rod, shown in broken lines at 106. Piston rod 106 forms a part of a feed leg, shown in its entirety in FIGS. 9 and 11. According to a typical procedure for fixedly but removably securing piston rod 106 to upper support flange 32, fastener bolt 44 is removed from upper support flange 32, followed by screwing portion 44*a* into the end of piston rod 106, and then inserting portion 44*b* through hole 102 and screwing nut 104 onto portion 44*b* so as to abut the lower surface of upper support flange 32.

Figure 7:
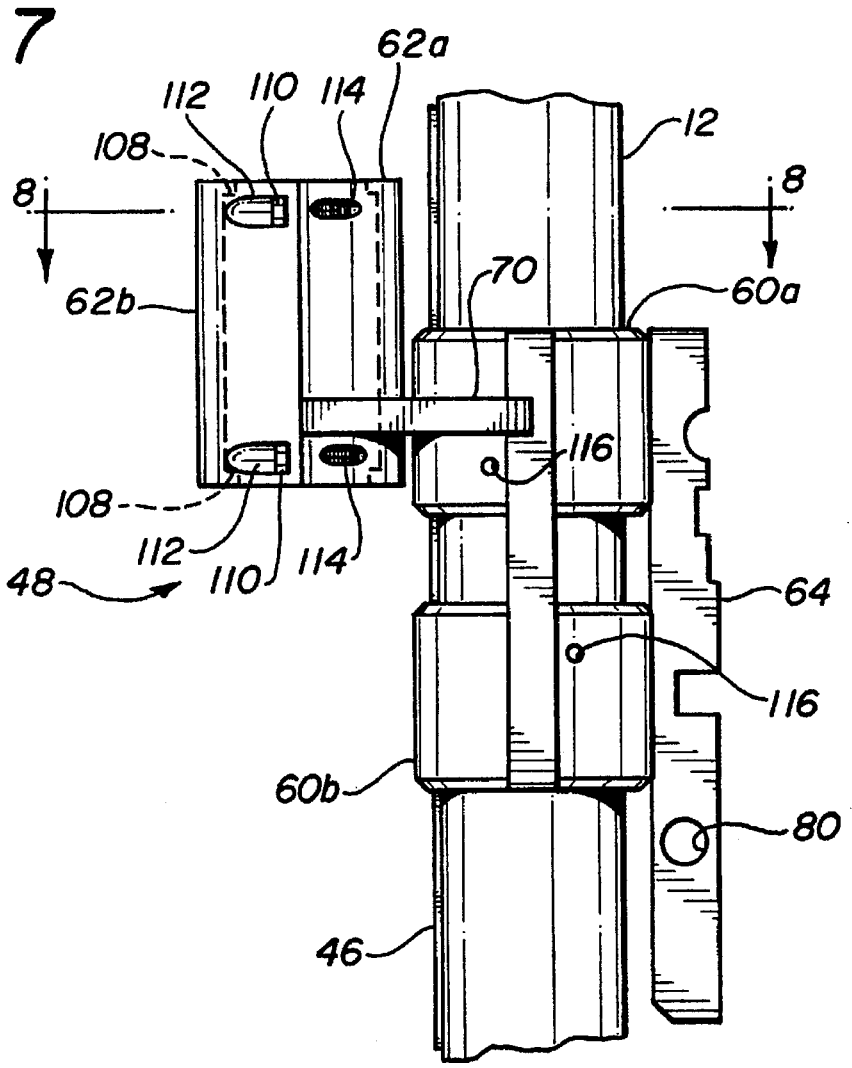
FIG. 7 is a side view of another portion of the support mount assembly shown in FIGS. 1 and 2.

Referring now to FIG. 7, this view more clearly shows details of carriage 48. In particular with regard to collar 62, its interior surface is shown in broken lines as having lips 108 at the upper and lower ends thereof, which are adapted to engage the exterior surface of a cylinder of a feed leg. Collar halves 62*a* and 62*b* are fixedly but separably secured to one another by bolts 110 which are received through holes 112 in the wall of collar half 62*b*. Bolts 110 are threadedly received in threaded holes 114 in the wall of collar half 62*a*. Of course, only two bolts 110 and their corresponding holes are shown in FIG. 7, but two more bolts and corresponding holes are provided on the other side of collar 62. Each of sleeve members 60*a* and 60*b* has a pair of grease zerts 116 (only one of which is shown in FIG. 7) into which grease can be injected for lubrication purposes.

Figure 8:
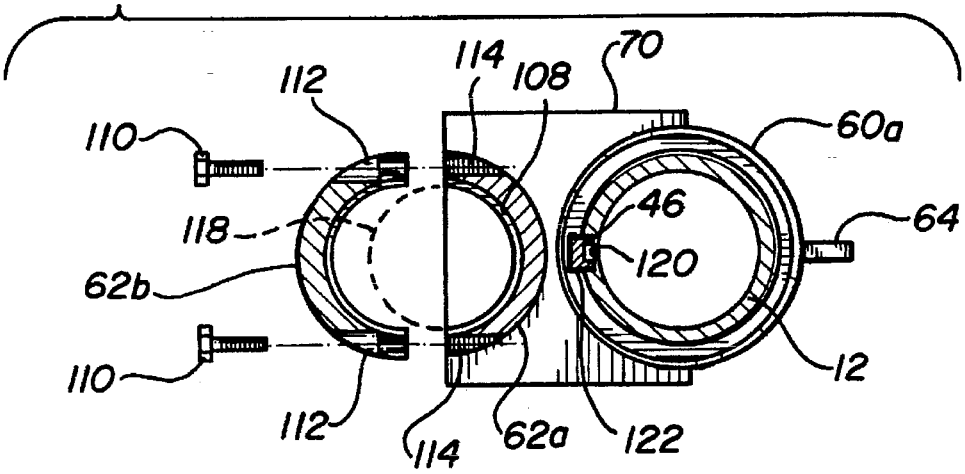
FIG. 8 is a cross-sectional and partially disassembled view along line 8—8 in FIG. 7.

Referring now to FIG. 8, this partially disassembled view more clearly shows the manner in which holes 112 transversely extend through the wall of collar half 62*b* and holes 114 transversely extend through the wall of 62*a*, and further shows bolts 110 as removed from holes 112 and 114 to allow separation of the collar halves. A broken line at 118 shows the manner in which a cylinder of a feed leg is coaxially positioned with respect to collar half 62*a* with collar half 62*b* separated therefrom. Therefore, bolts 110 can be partially or completely removed in order to position cylinder 118 within collar 62, followed by screwing bolts 110 back into threaded holes 114 to reassemble collar 62. Lips 108 tightly engage the exterior surface of cylinder 118 such that the cylinder is securedly but removably received by collar 62. FIG. 8 also shows a groove 120 in support member 12 in which key bar 46 is fixedly received, and a slot 122 in sleeve member 60*a* in which key bar 46 is received to guide the sleeve 60 in its longitudinal movement along support member 12. Of course, sleeve member 60*b* has a slot identical to slot 122.

With respect to materials used in support mount assembly 10, steel is the preferred material for all of its components. More particularly, a mild steel can be employed for most components. However, an 8620 steel alloy is the most preferred material for the lower support flange 34, key bar 46, pivot pin housing 50, pivot pin 52, pivot lock pin housing 90, and pivot lock pin 92.

Figure 9:
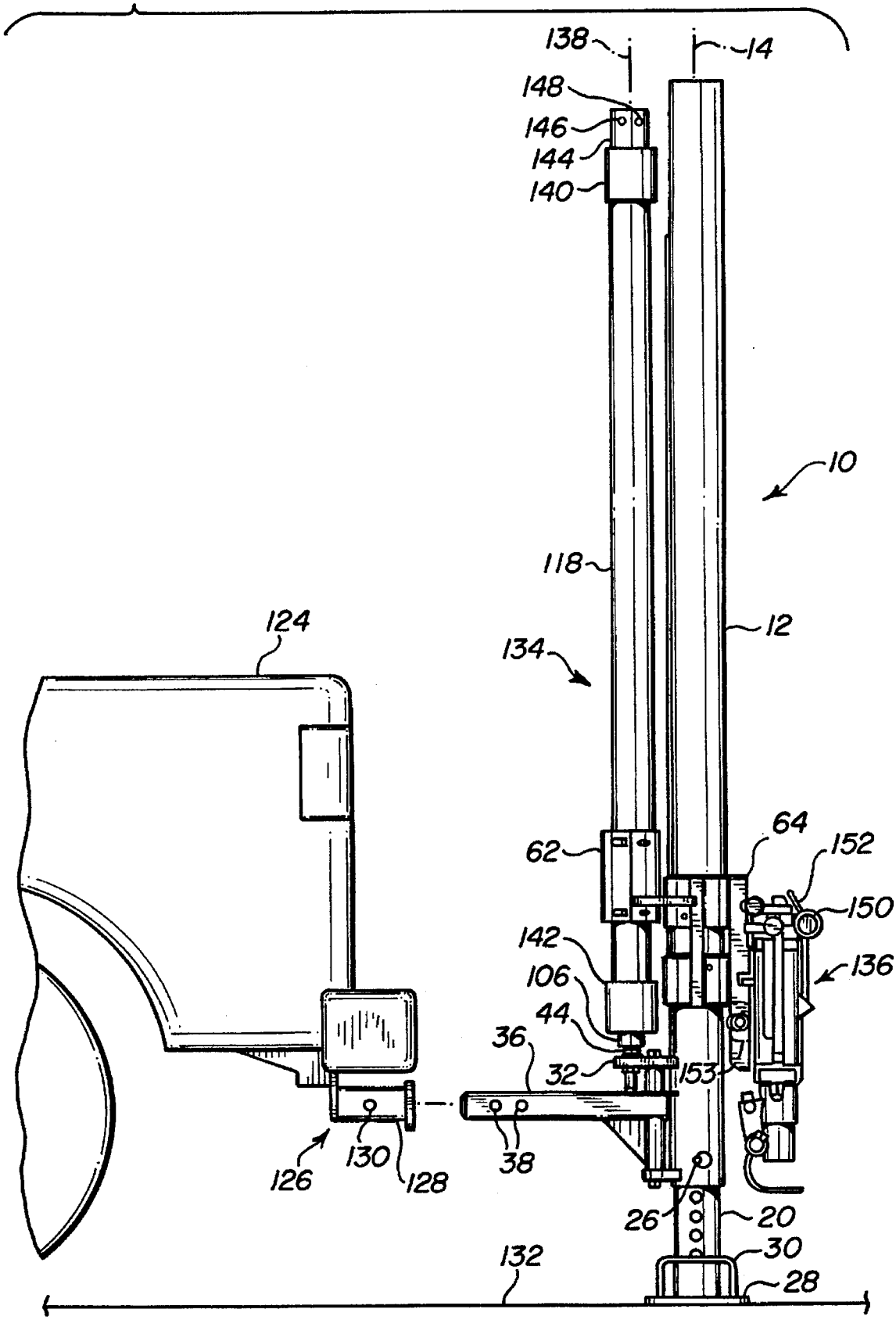
FIG. 9 is a view of the support mount assembly of FIGS. 1 and 2 with a feed leg and drill fixedly secured thereto, and additionally showing such assembly adjacent to but not yet connected to a vehicle.

Referring now to FIG. 9, there is shown a vehicle 124, in this case a pickup truck, having a hitch 126 fixedly secured to its frame in a conventional manner. Hitch 126 is the type which comprises a tubular member 128 having a hole 130 in its wall, and also an opposing radially aligned hole not visible in FIG. 9. Support mount assembly 10 is shown as having its pad 28 in contact with a substantially horizontal surface 132, such as a road or the ground, with support member 12 in a vertical orientation. It can be seen that connector 36 is sized to fit coaxially within tubular member 128 with a desired pair of holes 38 and 78 (FIG. 2) aligned with hole 130 and its opposing hole.

Support mount assembly 10 is further shown with a feed leg 134 and drill 136 fixedly but removably secured thereto. Normally, feed leg 134 and drill 136 would be so secured to support mount assembly 10 prior to hauling to the job site. Most conveniently with pickup truck 124, support mount assembly 10 with feed leg 134 and drill 136 would be loaded into the bed of pickup truck 124 and hauled to the job site, and then removed from the bed (with the assistance of handle 30) and placed in a vertical orientation with pad 28 in contact with surface 132. Of course, connector 36 must be at a vertical height to be aligned with tubular member 128. Therefore, foot member 20 must be locked, by means of foot lock pin 26, in the appropriate position relative to support member 12 to position connector 36 at the desired vertical position.

Feed leg 134 is shown as comprising cylinder 118 and a piston, having piston rod 106, reciprocatingly received within the cylinder in a conventional manner. Cylinder 118 is fixedly but removably secured within collar 62 in the manner discussed above, and the end of piston rod 106 is fixedly but removably secured to upper support flange 32 in a manner also previously discussed employing fastener bolt 44. As shown, feed leg 134 is vertically oriented so that its longitudinal axis 138 is substantially parallel to axis 14. Caps 140 and 142 are provided at each end of cylinder 118 to seal such ends, and a pneumatic coupling 144 having ports 146 and 148 is connected to cap 140. Cylinder 118 is vertically movable in an upward or downward direction by a pneumatic control system, further discussed below, which selectively delivers compressed air to either port 146 or port 148. One port communicates with the cylinder interior on one side of a piston head (not shown), and the other port communicates with the cylinder interior on the other side of the piston head in a conventional fashion.

Drill 136 is preferably a rock drill capable of drilling holes into or otherwise breaking up solid rock as well as asphalt and concrete. Drill 136 can be a conventional rock drill normally used for hand-held operation, and is preferably pneumatically controlled through a port 150. Indicated at 152 is a throttle which regulates the flow rate of compressed air from port 150 into the drill. Drill 136 is fixedly but removably secured to flange 64 by means of a flange 153 extending from drill 136, most clearly shown in FIG. 10. A hole 154 in flange 153 is aligned with hole 80 (FIGS. 2 and 7) in flange 64, and the thus aligned holes receive a bolt or other suitable fastener therethrough.

Figures 10, 11:
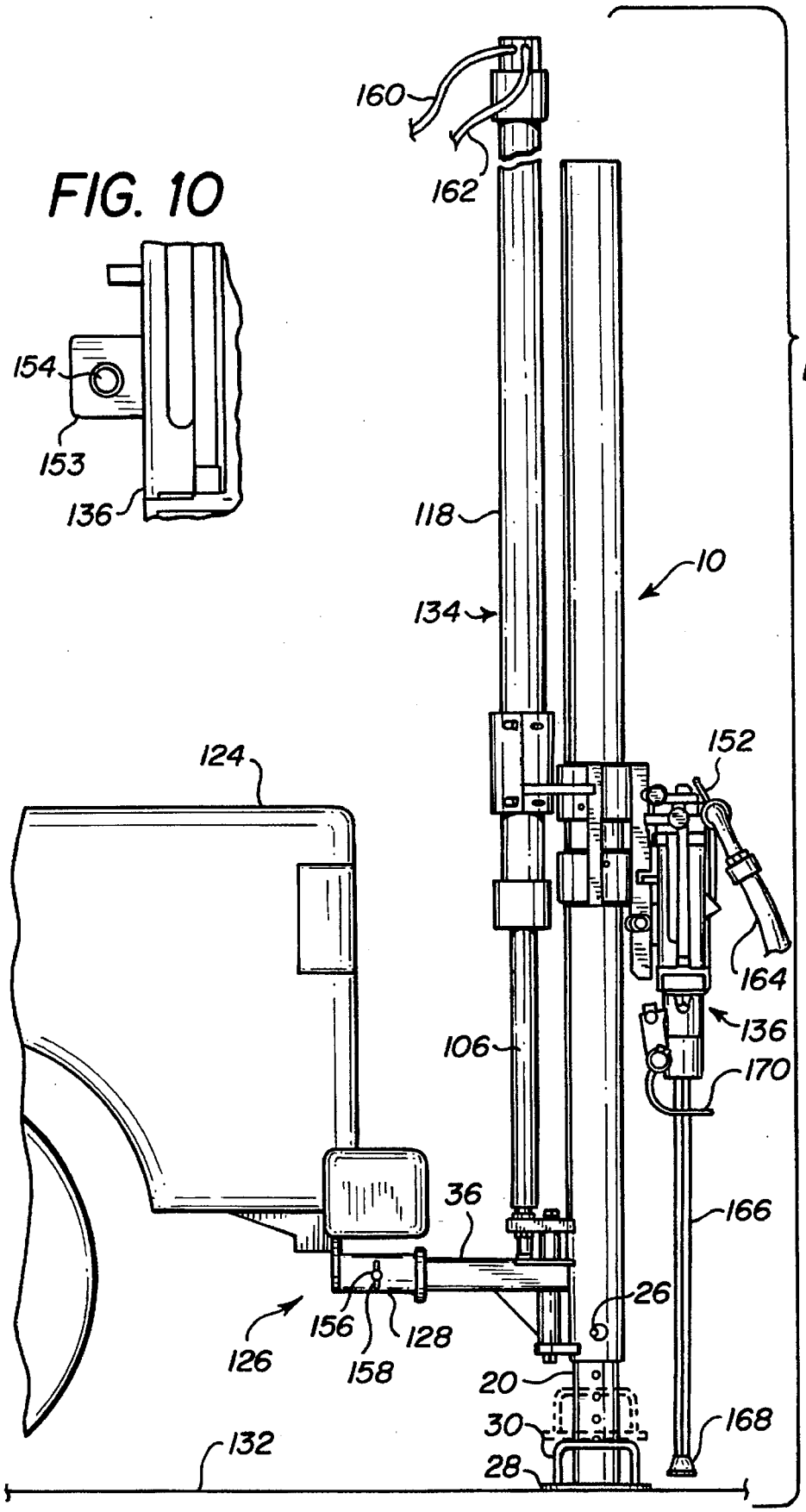
FIG. 10 is a fragmentary view of the drill shown in FIG. 9 but not secured to the support mount assembly.
FIG. 11 is a view of the support mount assembly of FIGS. 1 and 2 with the feed leg and drill fixedly secured thereto, and additionally showing such assembly as connected to the vehicle for use in a drilling operation.

Referring now to FIG. 11, support mount assembly 10, with feed leg 134 and drill 136 secured thereto, is shown as being fixedly secured to hitch 126 of pickup truck 124. A hitch pin 156 is received through the aligned holes of tubular member 128 and connector 36, and is retained in such position by a cotter pin or other suitable pin 158. After making this connection, air lines 160 and 162 are connected to ports 146 and 148 (FIG. 9), respectively, preferably using quick connect type fittings. Air line 164 is connected to port 150 (FIG. 9), preferably using a screw type fitting. Air lines 160, 162, and 164 should, of course, have sufficient flexibility (i.e. rubber) and length to accommodate the vertical movement of feed leg 134 and drill 136. Only a portion of each such air line is shown in FIG. 11 for clarity of illustration. Air is appropriately supplied by the pneumatic control system to feed leg 134 to raise cylinder 118 to a position as shown, thereby raising drill 136 to the illustrated position. A drill stem 166, or "steel", having a drill bit 168 connected to its lower end, is then fixedly secured by conventional means to the lower end of drill 136 so as to extend from the drill in a substantially downward direction. The drilling apparatus as comprised by support mount assembly 10, feed leg 134, and drill 136, is now ready for drilling.

The pivot feature previously described can be employed to adjust the position of drill 136 and drill stem 166 relative to surface 132. Therefore, slight adjustments can be made prior to drilling without having to move pickup truck 124.

With throttle 152 typically set to the fully open position, air is supplied to drill 136 through air line 164 to start the drill operating. Drill 136 most preferably operates to reciprocate drill stem 166 upward and downward, and simultaneously rotates drill stem 166 in a conventional manner. "Steel" puller 170 functions to keep drill stem 166 in its desired vertical position during operation. Air is now supplied appropriately to feed leg 134 in order to lower drill 136 so that drill bit 168 contacts the portion of surface 132 being drilled. After drilling is accomplished to the desired depth, drill 136 is raised back up.

Before moving to a new location, the drilling apparatus can be pivoted to a different position if necessary to enlarge a hole already drilled, or to drill another hole closely adjacent to the original hole.

Foot member 20 and pad 28 can be raised (using handle 30) to a position such as that shown in broken lines and out of contact with surface 132, and then locked in this position using foot lock pin 26. With pad 28 in such raised position, and if moving to a new location only a short distance away, the drilling apparatus can remain connected to pickup truck 24 while driving to the new location. In many applications, particularly light duty drilling into asphalt or concrete to a depth of only a few feet, foot member 20 and pad 28 can be in such raised position during drilling. This allows the operator to drill a number of holes at different locations without ever disconnecting the drilling apparatus or adjusting the vertical position of foot member 20 and pad 28. Once drilling is completed, pad 28 is lowered to contact surface 132, and the drilling apparatus is disconnected from pickup truck 124 and loaded back into the truck bed.

Since feed leg 134 and drill 136 are removably secured to support mount assembly 10 according to preferred aspects discussed above, feed leg 134 and drill 136 can be removed from the support mount assembly and used in mining applications not employing such assembly, such as in horizontal "jackleg" drilling into a mine wall.

Figure 12:
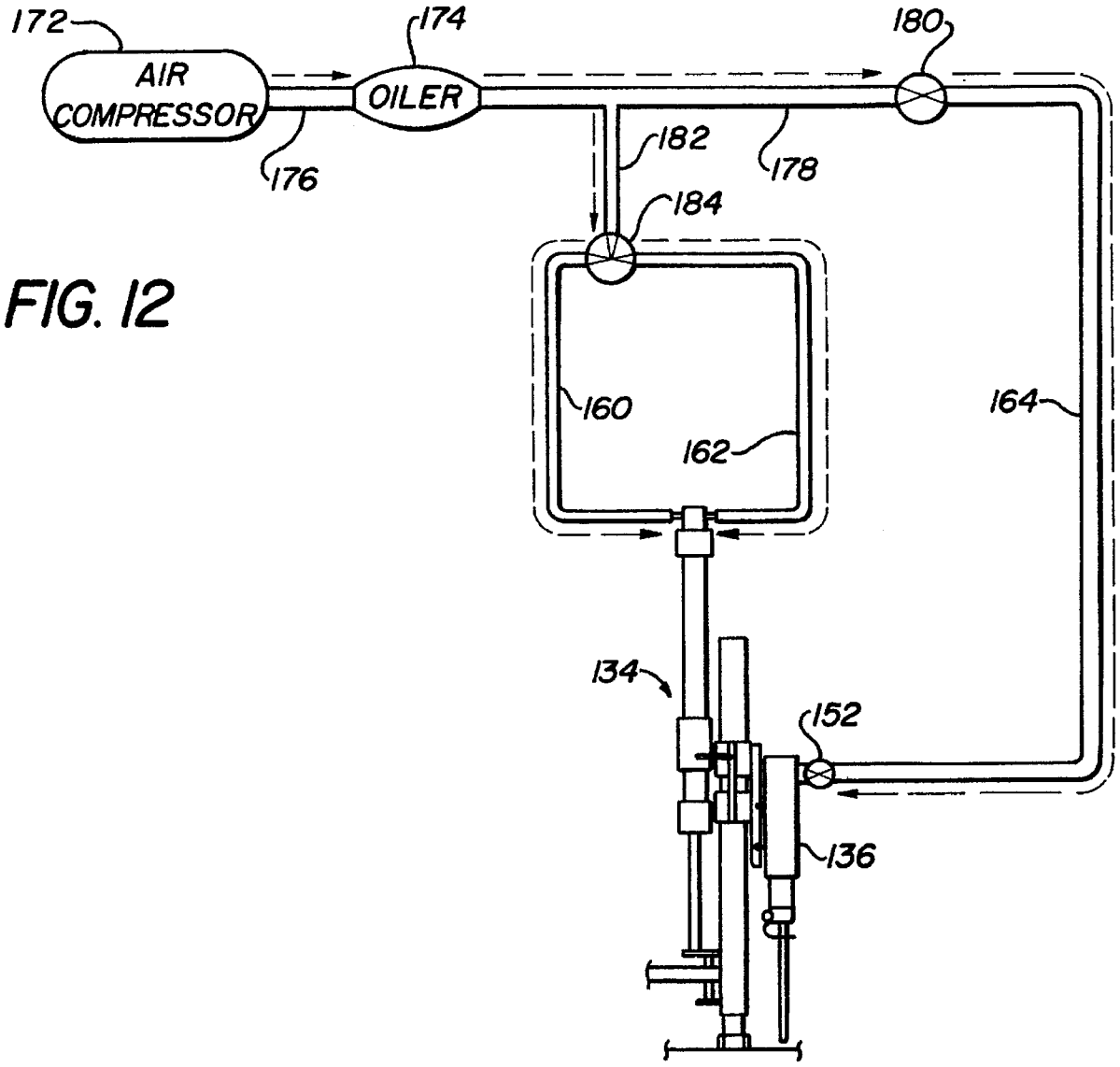
FIG. 12 is a schematic diagram of a pneumatic control system for operating the feed leg and drill shown in FIG. 11.

Referring now to FIG. 12, the illustrated pneumatic control system includes an air compressor 172 for compressing air to a pressure of preferably about 100 psi, an oiler 174 for supplying oil to lubricate feed leg 134 and drill 136, an air line 176 extending between compressor 172 and oiler 174, an air line 178 extending from oiler 174 to a valve 180, air line 164 extending from valve 180 to throttle 152 associated with drill 136, an air line 182 extending from air line 178 (by an appropriate fitting not shown) to a valve 184, and air lines 160 and 162 extending from valve 184 to feed leg 134. Valve 180 and throttle 152 each have two positions, either open or closed. Valve 184 is adjustable to regulate the flow of air through either of lines 160 and 162 to feed leg 134. The direction of air flow is indicated by broken arrows.

To operate feed leg 134, valve 184 can be set to deliver air through air line 160 or air line 162 at the appropriate pressure to raise, lower, or hold drill 136 in a certain position. To operate drill 136, throttle 152 is set to a fully open position and valve 180 can then be opened to supply air to drill 136 and start operation of the drill. Valves 180 and 184 can be manually controlled by an operator at a location (such as in the cab of a pickup truck) remote from drill 136.

Thus, there is provided by the invention a support mount assembly and drilling apparatus employing such assembly which is highly portable, capable of remote operation for maximum safety, and cost effectively useful in a variety of different drilling applications as discussed in the Summary of the Invention.

Obviously, many modifications and variations of the present invention are possible in light of the above teachings. It is, therefore, to be understood that within the scope of the appended claims, the invention can be practiced other than as specifically described.

That which is claimed is:

1. A drilling apparatus for use with a vehicle comprising:

an elongated and substantially cylindrical support member having a longitudinal axis and opposing ends;

a connector means for removably connecting the support member to the vehicle so as to hold the support member in at least one substantially vertically oriented fixed position with one end as the lower end and the other end as the upper end;

a support flange integrally connected to and substantially radially and outwardly extending from the support member near the lower end thereof;

a carriage having (i) a sleeve slidably received upon the support member so as to be longitudinally movable along a portion of the support member between the support flange and the upper end of the support member, (ii) a feed mount member having at least a portion integrally connected to the sleeve and wherein the feed mount member outwardly extends from the sleeve, and (iii) a drill mount member integrally connected to and outwardly extending from the sleeve;

an elongated feed leg means having a longitudinal axis substantially parallel to the support member axis and having a first feed leg member fixedly secured to the feed mount member and a second feed leg member fixedly secured to the support flange, the first feed leg member being movably connected to the second feed leg member so as to be longitudinally movable with respect to the second feed leg member to thereby move the carriage in an upward or downward direction along said portion of the support member; and a drill means fixedly secured to the drill mount member in an orientation to receive a drill stem which extends from the drill means in a substantially downward direction.

2. A drilling apparatus as recited in claim 1 wherein the connector means is adapted to connect the support member to a hitch which is fixedly secured to the vehicle.

3. A drilling apparatus as recited in claim 2 wherein the connector means comprises a tubular member having a longitudinal axis substantially perpendicular to the support member axis.

4. A drilling apparatus as recited in claim 3 wherein the support flange is hereafter denoted as the upper support flange, and wherein the drilling apparatus further comprises a lower support flange integrally connected to and substantially radially and outwardly extending from the support member at a position between the upper support flange and the lower end of the support member or at such lower end, the connector means being pivotally connected to and between the upper and lower support flanges to permit the support member to pivot around a pivot axis substantially parallel to the support member axis, and wherein the drilling apparatus further comprises a pivot locking means for locking the support member in any one of a plurality of positions about the pivot axis.

5. A drilling apparatus as recited in claim 4 wherein, in the carriage, the sleeve is substantially cylindrical and is substantially coaxially positioned with respect to the support member, the feed mount member comprises a substantially cylindrical collar which is substantially coaxial with the feed leg means and which securedly but removably receives the second feed leg member therethrough, and the drill mount member comprises a flange to which the drill means is removably secured thereto and which longitudinally extends along the sleeve.

6. A drilling apparatus as recited in claim 5 wherein the collar comprises a first collar half integrally connected to the sleeve and a second collar half separable from the first collar half to allow removal of the second feed leg member from the collar.

7. A drilling apparatus as recited in claim 6 wherein the first feed leg member is a cylinder and the second feed leg member is a piston reciprocatingly received within the cylinder, the piston having a piston rod end fixedly but removably secured to the upper support flange.

8. A drilling apparatus as recited in claim 7 wherein the drill means is a rock drill.

9. A drilling apparatus as recited in claim 8 wherein the drill means and feed leg means are pneumatically controlled.

10. A drilling apparatus as recited in claim 9 wherein the support member is a tubular member.

11. A drilling apparatus as recited in claim 10 further comprising: a tubular foot member having an upper end and a lower end and being substantially coaxially and telescopically received within the support member through its lower end such that the upper end of the foot member is within the support member; a means for locking the foot member in any one of a plurality of longitudinally spaced positions with respect to the support member; and a pad integrally connected to the lower end of the foot member and having a substantially planar surface substantially perpendicular to the support member axis, whereby the planar surface of the pad can engage a substantially horizontal surface with the support member in its substantially vertical orientation as connected to the vehicle.

12. A support mount assembly for use with a vehicle comprising:

an elongated and substantially cylindrical support member having a longitudinal axis and opposing first and second ends;

a connector means for removably connecting the support member to the vehicle so as to hold the support member in at least one substantially vertically oriented fixed position with one end as the lower end and the other end as the upper end;

a first flange integrally connected to and substantially radially and outwardly extending from the support member near the lower end thereof;

a substantially cylindrical sleeve substantially coaxial with the support member and slidably received upon the support member so as to be longitudinally movable along a portion of the support member between the first flange and the upper end;

a substantially cylindrical collar having at least a portion integrally connected to the sleeve, wherein the collar outwardly extends from the sleeve and has a longitudinal axis substantially parallel to the support member axis, and wherein the collar is longitudinally aligned with at least a portion of the first flange; and a second flange integrally connected to and outwardly extending from the sleeve so as to longitudinally extend along the sleeve.

13. A support mount assembly as recited in claim 12 wherein the connector means is adapted to connect the support member to a hitch which is fixedly secured to the vehicle.

14. A support mount assembly as recited in claim 13 wherein the connector means comprises a tubular member having a longitudinal axis substantially perpendicular to the support member axis.

15. A support mount assembly as recited in claim 14 further comprising a third flange integrally connected to and substantially radially and outwardly extending from the support member at a position between the first flange and the lower end of the support member or at such lower end, the connector means being pivotally connected to and between the first and third flanges to permit the support member to pivot around a pivot axis substantially parallel to the support member axis, and wherein the support mount assembly further comprises a pivot locking means for locking the support member in any one of a plurality of positions about the pivot axis.

16. A support mount assembly as recited in claim 15 wherein the collar comprises a first collar half integrally connected to the sleeve and a second collar half separable from the first collar half.

17. A support mount assembly as recited in claim 16 wherein the support member is a tubular member.

18. A support mount assembly as recited in claim 17 further comprising: a tubular foot member having an upper end and a lower end and being substantially coaxially and telescopically received within the support member through its lower end such that the upper end of the foot member is within the support member; a means for locking the foot member in any one of a plurality of longitudinally spaced positions with respect to the support member; and a pad integrally connected to the lower end of the foot member and having a substantially planar surface substantially perpendicular to the support member axis, whereby the planar surface of the pad can engage a substantially horizontal surface with the support member is in its substantially vertical orientation as connected to the vehicle.

* * * * *